US007621231B2

(12) United States Patent
McNeely

(10) Patent No.: US 7,621,231 B2
(45) Date of Patent: Nov. 24, 2009

(54) DOSAGE REMINDER CAP

(76) Inventor: Kevin McNeely, 2621 Colleen Dr., Arlington, TX (US) 76016

( * ) Notice: Subject to any disclaimer, the term of this patent is extended or adjusted under 35 U.S.C. 154(b) by 43 days.

(21) Appl. No.: 11/935,611

(22) Filed: Nov. 6, 2007

(65) Prior Publication Data

US 2008/0060969 A1 Mar. 13, 2008

Related U.S. Application Data

(63) Continuation of application No. 11/234,335, filed on Sep. 23, 2005, now abandoned.

(60) Provisional application No. 60/631,950, filed on Nov. 30, 2004.

(51) Int. Cl.
*G09F 11/04* (2006.01)
*A61J 7/04* (2006.01)

(52) U.S. Cl. ..... 116/308; 116/311; 116/315; 206/534; 206/459.1; 215/230

(58) Field of Classification Search ..... 116/284, 116/298, 305–309, 311–313, 315, 318; 206/459.1, 206/495.5, 534; 215/230; 235/116, 122
See application file for complete search history.

(56) References Cited

U.S. PATENT DOCUMENTS

| | | | | | |
|---|---|---|---|---|---|
| 332,208 | A * | 12/1885 | Noel | 116/308 |
| 3,753,417 | A * | 8/1973 | Garby | 116/308 |
| 4,011,829 | A * | 3/1977 | Wachsmann et al. | 116/308 |
| 4,749,093 | A * | 6/1988 | Trick | 215/220 |
| 4,832,220 | A * | 5/1989 | Quennessen | 215/331 |
| 5,011,032 | A * | 4/1991 | Rollman | 215/230 |
| 5,452,792 | A * | 9/1995 | Zautke et al. | 206/5.1 |
| 5,638,970 | A * | 6/1997 | Garby et al. | 215/219 |
| 5,732,836 | A * | 3/1998 | Barker et al. | 215/230 |
| 5,803,283 | A * | 9/1998 | Barker et al. | 215/230 |
| 5,984,122 | A * | 11/1999 | Barker et al. | 215/230 |
| 7,017,762 | B2 * | 3/2006 | Shane | 215/230 |
| 2006/0124501 | A1 * | 6/2006 | McNeely | 206/534 |
| 2008/0060969 | A1 * | 3/2008 | McNeely | 206/534 |

* cited by examiner

*Primary Examiner*—Amy C Johnson
(74) *Attorney, Agent, or Firm*—Michael A. O'Neil, P.C.

(57) ABSTRACT

A dosage reminder cap provides an easy, effective way to track consumption of medication. A rotating disk provides a tool for marking the either last dose taken or the next dose due to be taken of a prescribed medication in order to facilitate proper consumption of the medication.

1 Claim, 4 Drawing Sheets

DOSAGE REMINDER CAP

CROSS-REFERENCE TO RELATED APPLICATIONS

This application is a continuation application of application Ser. No. 11/234,335 filed Sep. 23, 2005, now abandoned, the entire content of which is incorporated herein by reference; which claims priority of prior provisional Application Ser. No. 60/631,950 filed Nov. 30, 2004, the entire content of which is incorporated herein by reference.

TECHNICAL FIELD

This invention relates generally to medicine containers, and more particularly to a dosage reminder cap for prescription medicine containers providing an indication of when the next dose of medicine is due and facilitating tracking of the last dose dispensed from the container.

BACKGROUND AND SUMMARY OF THE INVENTION

All prescription medications are accompanied by a doctor's directions for the frequency and amount of each dose to be consumed by a patient. Many medications must be taken daily in order to be effective, some at multiple intervals during the day. Other medications are only taken as needed, but a patient or care giver needs to know when the last dose was taken to prevent over-dosing. Some of the hazards associated with incorrect consumption, commonly called noncompliance, of medications include prolonged illness, ineffectiveness of the medicine, hospitalization, commitment into a nursing home facility, and death. All of the aforementioned hazards eventually result in increased health care costs to patients and society as a whole.

Several medicine dose tracking devices are currently available to consumers. Some comprise a container with compartments for multiple doses per day of the week. Others provide an indicator for each day of the week, either on the container closure or on a label placed inside the container whereby each dose of medicine is sealed in an individual packet and dispensed by pushing through a layer of foil. Other devices track the number of times a container has been opened. Each of these devices has limitations.

Devices that track only the day of the week do not provide any way to track multiple doses per day, unless the medicine is packaged in a foil-lined packet. A foil-lined packet with multiple doses per day is impractical when there are two or more doses per day, because a prescription for longer than a few days requires a package of considerable size, even for the smallest of pills.

Multiple compartment containers allow patients to place multiple medications together or single, multiple-dose medications into compartments according to the number of doses per day. Although such containers are common, they violate the legal requirement that medications must be stored in properly labeled containers. In addition to the labeling requirement, there are no child safety features and no remedy for displacement of medication, for example falling out of the container; mixing of the doses of medication; or incorrectly dispensing the medication into the container.

Devices that track the number of times a container is opened present several difficulties. Devices currently available do not provide for opening the container and not taking a dose. Further, there is nothing to help track when the last dose was taken or when the next dose is due, and no way of tracking the quantity of medicine dispensed when the container was opened. In addition to the dosage tracking limitation, available container caps and other constructions are generally round in shape, which do not prohibit the container from rolling off of the surface upon which it was placed.

The present invention comprises a dosage reminder cap which overcomes the foregoing and other difficulties which have long since characterized the prior art. In accordance with the broader aspects of the invention, a dosage reminder cap contains a dial which is rotated and set to indicate either the last day and dose when the medication was taken or when the next dose is due.

In accordance with more specific aspects of the invention, a dosage reminder cap for a medicine container comprises a hexagonal shape with each day of the week and multiple doses per day displayed thereon. A round disk with a small window cutout (window disk) is recessed into the hexagonal cap and is affixed therein. The user rotates the window disk clockwise until the desired day and dose is revealed through the window.

The hexagon shape of the cap prevents the container from rolling and falling off the surface upon which it was placed. The hexagon shape also makes the cap easier to grip and therefore easier to open. The cap is further equipped with a child safety feature for deterring a child from removing the cap from the container and thereby gaining access to the contents thereof.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
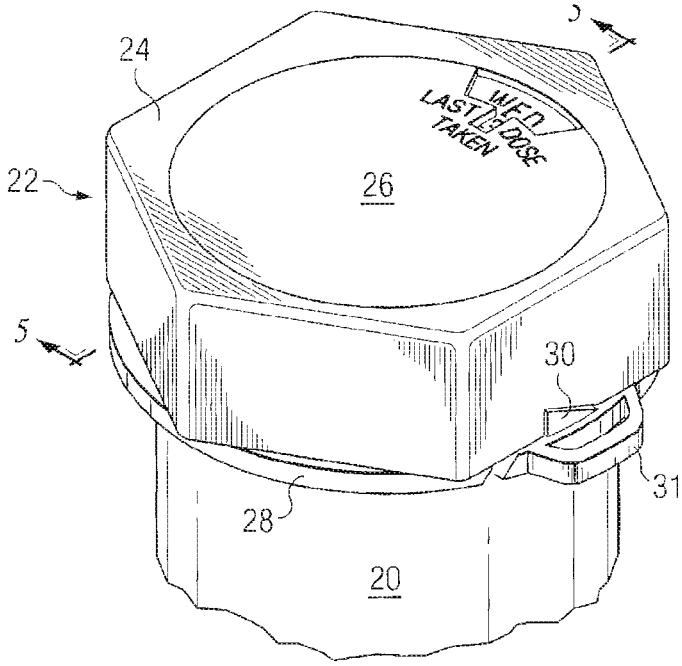
FIG. 1 is a perspective view of a dosage reminder cap comprising a first embodiment of the present invention.

Referring now to the drawings, and particularly to FIG. 1 thereof, there is shown a medicine container 20 having a dosage reminder cap 22 installed thereon. The dosage reminder cap 22 comprises a hexagon shaped base 24 and a window disk 26. The dosage reminder cap 22 threadedly engages the top of the container 20 until it rests upon a lip 28 around the container 20. The lip 28 has a detent 30 and a tab 31 on one side thereof providing a child safety feature.

Figure 2:
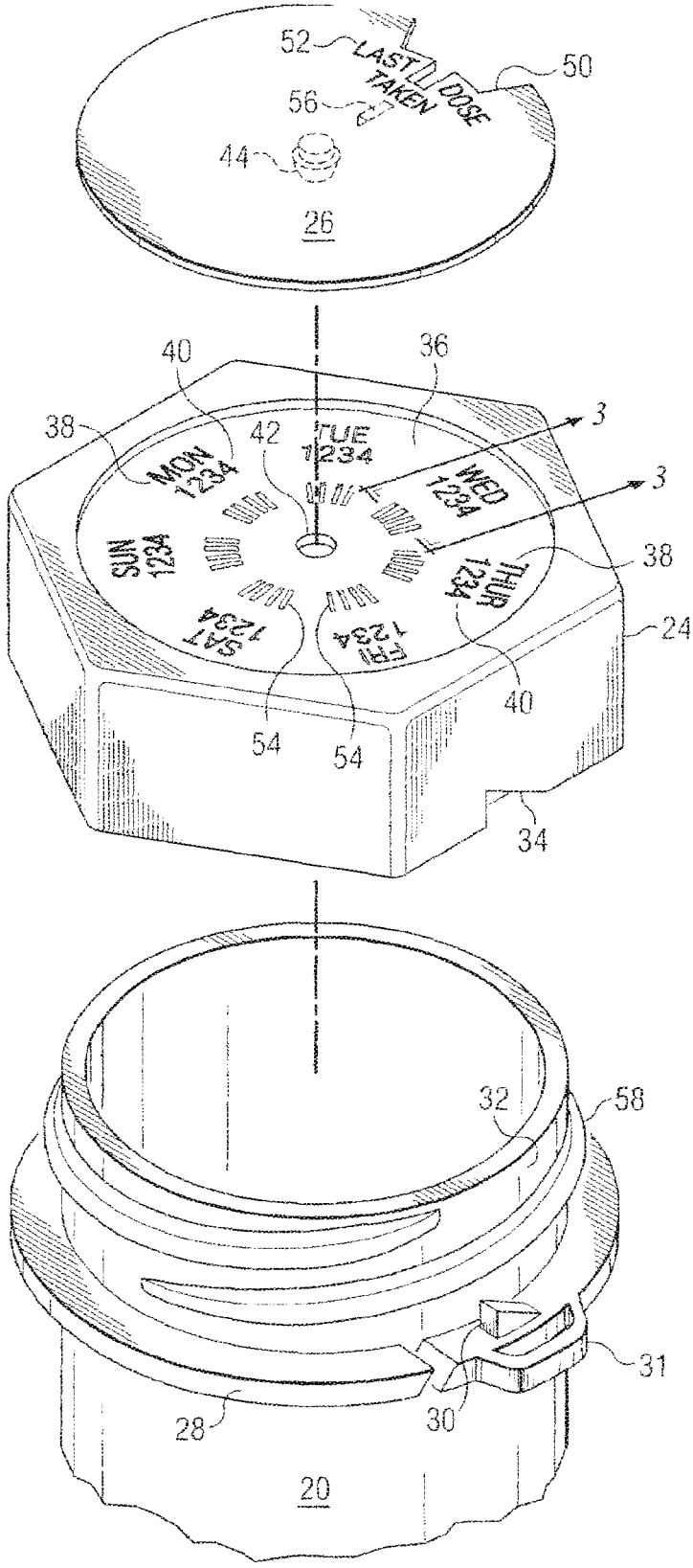
FIG. 2 is an exploded perspective view of the dosage reminder cap shown in FIG. 1.

Referring to FIG. 2, there is shown an enlarged, exploded view of the embodiment shown in FIG. 1. The dosage reminder cap 22 fastens onto the container 20 by engaging a threaded neck 32 of the container 20. A notch 34 formed in the base 24 engages the detent 30 and locks the dosage reminder cap 22 in place. In order to unscrew and remove the dosage reminder cap 22, the tab 31 is pressed down enabling the base 24 to disengage the detent 30. The base 24 is thereafter pressed down and turned in a counterclockwise direction at the same time.

The hegaxon shaped base 24 comprises a cavity 36 in the top center thereof which is sized to accommodate the window disk 26 recessed therein. Printed within the cavity 36 are two concentric text rows 38 and 40. The outer row 38 has each of the seven days of the week spaced at equal intervals therearound. The inside row 40 comprises sets of sequential numbers located below, concentric with and aligned with each day of the week displayed in the outer row 38, each set of numbers beginning with the number 1. In the center of the cavity 36 is an opening 42 for accommodating a pin 44 protruding from the bottom of the window disk 26. The pin 44 snaps into the opening 42 thereby securing the window disk 26 to the base 24 and providing the axis about which the window disk 26 turns.

The window disk 26 has a T-shaped window 50 cut out of one edge thereof. The window 50 displays one day of the week from the outer row 38 and one number from the inner row 40. Below the window 50 is indicator text 52 to assist the patient or person dispensing the medicine. The text 52 comprises the words "Last Dose Taken." Alternative texts are "Next Dose Due", "Next Dose To Be Taken", or other alternative phrases having similar meanings.

The window disk 26 rotates counterclockwise and stops when the desired day and dose number are displayed through the window 50. A series of notches 54 are formed in the face of the cavity 36, such that there is one notch 54 for each corresponding dose number of the inner row 40. The notches 54 engage a triangular wedge 56 protruding from the bottom of the window disk 26 thereby locking the window disk 26 in place when the desired day and dose number are displayed through the window 50. To change the day and dose number displayed, a person dispensing the medicine turns the window disk 26 by pressing down in the disk with a thumb or other finger.

Figure 3:
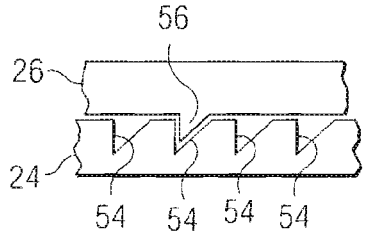
FIG. 3 is a section view taken along the line 3-3 in FIG. 2.

Referring now to FIG. 3, there is shown the engagement of the wedge 56 and the notches 54. The wedge 56 and the notches 54 have the shape of an isosceles triangle. The isosceles triangle shape allows the wedge 56 to continue forward to the next notch 54 while preventing the wedge 56 from going back to the previous notch 54.

Figure 4:
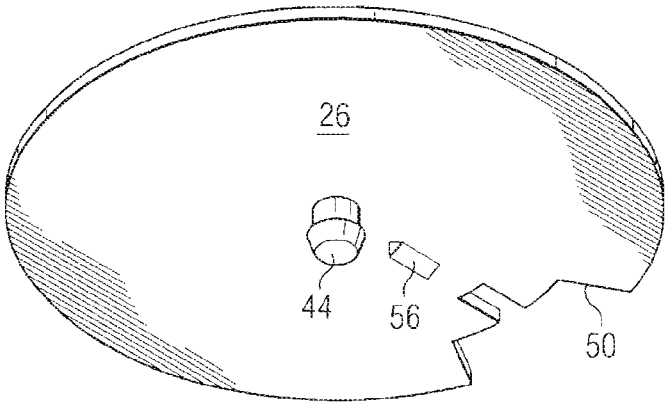
FIG. 4 is perspective view of one component of the dosage reminder cap shown in FIG. 1.

Referring now to FIG. 4, there is shown a view of the bottom of the window disk 26 illustrating the location of the pin 44 and the wedge 56.

Figure 5:
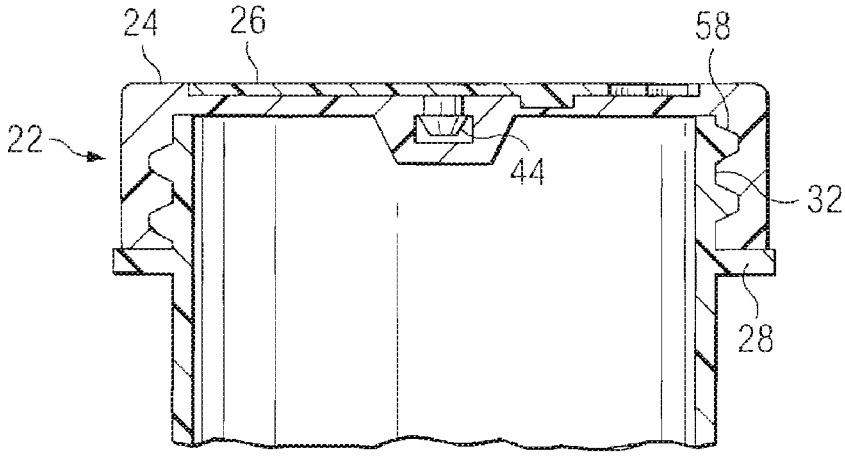
FIG. 5 is a sectional view taken along the line 5-5 in FIG. 1.

Referring now to FIG. 5, the dosage reminder cap 22 is shown secured in engagement with the container 20. The inner surface of the base 24 is threaded to engage corresponding threads 58 of the neck 32 of the container.

Figure 6:
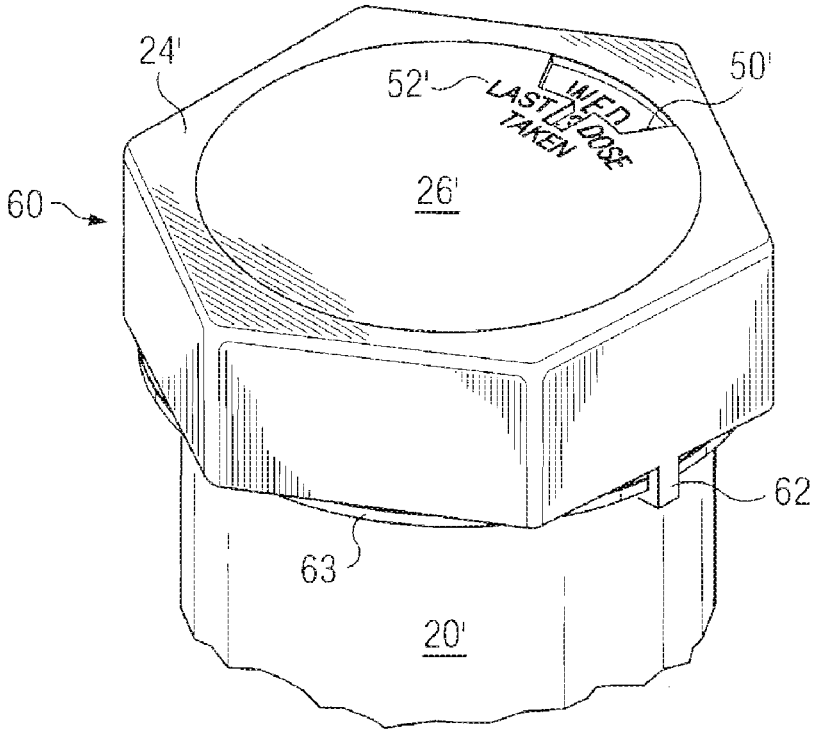
FIG. 6 is a perspective view of a dosage reminder cap comprising a second embodiment of the present invention.
Figure 7:
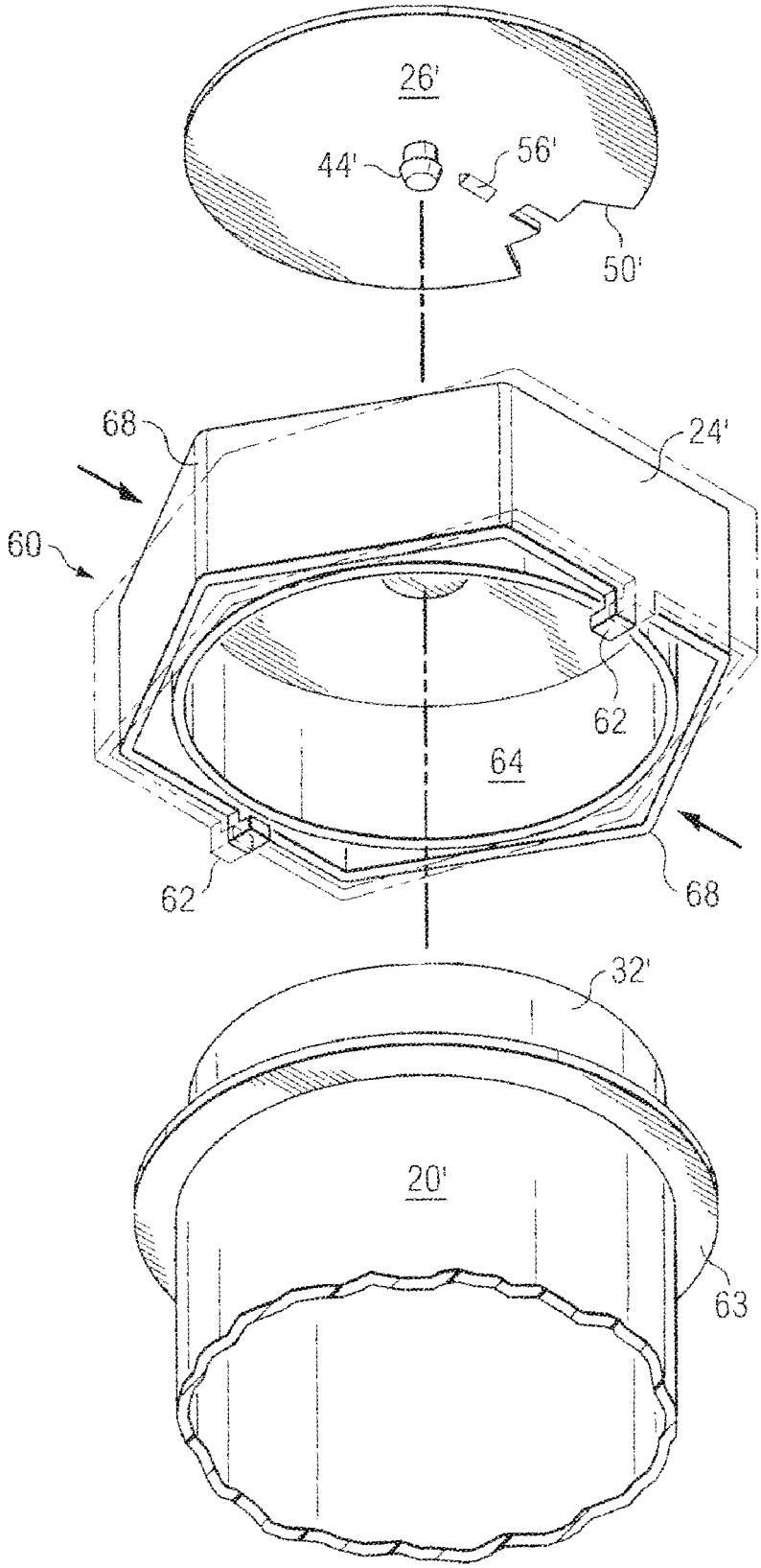
FIG. 7 is an exploded perspective view of the dosage reminder cap shown in FIG. 6.

FIGS. 6 and 7 illustrate a dosage reminder cap 60 comprising a second embodiment of the invention. Many of the component parts of the dosage reminder cap 60 are substantially identical in construction and function to component parts of the dosage reminder cap 22 illustrated in FIGS. 1 through 5 and described hereinabove in conjunction therewith. Such identical component parts are designated in FIGS. 6 and 7 with the same reference numerals utilized above in the description of the dosage reminder cap 22, but are differentiated therefrom by means of a prime (') designation.

The dosage reminder cap 60 differs from the dosage reminder cap 22 in that the dosage reminder cap 60 employs an alternative closure and child safety mechanism for engagement with the container 20'. The base 24' of the dosage reminder cap 60 comprises two locking tabs 62 on opposite sides for engagement with a lip 63 of the container 20'. A circular inner surface 64 of the base 24' secures over the neck 32' of the container 20'.

As shown in FIG. 7, to remove the dosage reminder cap 60 from the container 20' pressure is applied to two pressure points 68 equidistant between the tabs 62 on opposite sides of the base 24'. As pressure is applied to the pressure points 68, the tabs 62 are forced outwardly thereby disengaging the tabs 62 from the lip 63 allowing the dosage reminder cap 60 to removed from the container 20'.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A medicine container cap which indicates the next dose of medicine to be taken comprising:

a base for engaging and thereby sealing a medicine container;

the base comprising a planar upper wall and at least one side wall extending substantially perpendicularly downward from the upper wall;

a disk-shaped cavity formed in the upper wall of the base and comprising a bottom wall located a predetermined distance below the upper wall and a side wall extending substantially perpendicularly upward from the bottom wall;

the disk-shaped cavity having a predetermined depth;

an aperture extending through the upper wall of the base at the center of the disk-shaped cavity;

the bottom wall of the disk-shaped cavity having two circular lines of indicia formed thereon, the circular lines of indicia being concentric with one another and with the aperture extending through the upper wall of the base;

the outer circular line of indicia comprising seven abbreviations each corresponding to one of the days of the week located at equally spaced intervals around the aperture formed through the upper wall of the base;

the inner line of indicia comprising repetitive sets of four dosage reminder numerals indicative of the number of times per day that a dose of medicine is to be taken, the repetitive sets of numerals being arranged at equally spaced intervals around the aperture formed in the upper wall of the base and aligned with the days of the week comprising the outer circular line of indicia;

the spacing between adjacent sets of four dosage reminder numerals being substantially greater than the spacing between the reminder numerals comprising each set;

a plurality of identical sets of triangularly shaped notches formed in the bottom wall of the disk-shaped cavity, the sets of triangular notches forming a circular array concentric with the aperture formed in the upper wall of the base;

each of the triangular notches corresponding to one of the dosage reminder numerals indicia formed on the bottom wall of the cavity;

a window disk having a diameter substantially equal to the diameter of the disk-shaped cavity formed in the upper wall of the base and having a thickness substantially equal to the predetermined depth of the disk-shaped cavity formed in the upper wall of the base;

the window disk having a locking pin extending downwardly therefrom for engagement with the aperture formed through the upper wall of the base to lock the window disk in engagement with the base while permitting rotation of the window disk relative to the base;

the window disk having a notch formed in the edge thereof for simultaneously displaying one of the days of the week and one of the dosage reminder numerals formed on the base of the cavity;

a triangular wedge formed on the underside of the circular disk for engagement with a selected triangular notch formed in the bottom surface of the cavity to lock the window disk at a predetermined rotational location relative to the base;

child-proof means for securing the base onto a medicine container; and wherein the notches of the cavity disposed in the disk-shaped cavity and the wedge protruding from the bottom side of the window disk comprise isosceles triangles which allow the wedge to move forward and engage the next subsequent notch while preventing the wedge from moving backward to engage the previous notch.

* * * * *